US006821149B2

(12) United States Patent
Lai

(10) Patent No.: US 6,821,149 B2
(45) Date of Patent: Nov. 23, 2004

(54) ELECTRICAL CONNECTOR HAVING IMPROVED SHIELDING MEMBER AND METHOD OF MAKING THE SAME

(75) Inventor: Chin-Te Lai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/302,060

(22) Filed: Nov. 21, 2002

(65) Prior Publication Data

US 2004/0043659 A1 Mar. 4, 2004

(30) Foreign Application Priority Data

Aug. 30, 2002 (TW) ..... 91213584 U

(51) Int. Cl.[7] ..... H01R 13/648
(52) U.S. Cl. ..... 439/607
(58) Field of Search ..... 439/607, 609, 439/610, 630

(56) References Cited

U.S. PATENT DOCUMENTS 5,167,531 A * 12/1992 Broschard et al. ..... 439/541.5
5,876,247 A * 3/1999 Hashimoto ..... 439/607
6,056,560 A * 5/2000 Wu et al. ..... 439/108
6,080,016 A * 6/2000 Ho et al. ..... 439/607
6,241,556 B1 6/2001 Chih ..... 439/607
6,315,608 B1 * 11/2001 Lopata et al. ..... 439/607
6,322,396 B1 11/2001 Kuan ..... 439/607
6,371,809 B1 4/2002 Chun-Yuan ..... 439/607

* cited by examiner

*Primary Examiner*—Chandrika Prasad
(74) *Attorney, Agent, or Firm*—Wei Te Chung

(57) ABSTRACT

An electrical connector (1) has an insulative base (10), a shielding member (12) and a number of terminals (13) received in the insulative base. The insulative base includes a base plate (101), a mating board (102) extending upwardly from the base plate and a pair of side portions (106) formed at lateral sides of the base plate. The base plate has a number of fixing members (105) and wedges (104). Each side portion defines a cavity (109) therein and forms a flange (107) on an inner wall thereof. The shielding member has a chamber (120) for accommodating the base plate and the mating board. The shielding member has a pair of mating holes (123) and mating recesses (122) for mating with corresponding wedges and fixing members of the base plate. The shielding member has a pair of lateral sides respectively received in corresponding cavities with bottom edges thereof abutting against corresponding flanges.

14 Claims, 3 Drawing Sheets

ELECTRICAL CONNECTOR HAVING IMPROVED SHIELDING MEMBER AND METHOD OF MAKING THE SAME

CROSS-REFERENCE TO RELATED APPLICATION

The present application is related to a commonly assigned and contemporaneously filed U.S. patent application Ser. No. 10/143,616, filed on May 9, 2002, entitled "ELECTRICAL CONNECTOR SUPPORTED ON PRINTED CIRCUIT BOARD". A copy of the specification is hereto attached.

BACKGROUND OF THE INVENTION

1. Field of the Invention

The present invention relates to an electrical connector, and particularly to an electrical connector having an improved shielding member with its lower portion received in a housing of the connector.

2. Description of Related Art

It is becoming more and more desirable to provide shieldings around electrical connectors to protect signals transmitted therethrough from electromagnetic and radio frequency interferences (EMI/RFI). U.S. Pat. No. 6,322,396 B1, issued to Kuan on Nov. 27, 2001, discloses an electrical connector comprising an insulating base 1 having a plurality of terminal receiving slots 10, a metal shielding member 2 covering the external periphery of the insulative base 1 such that the insulative base 1 is shielded.

U.S. Pat. No. 6,371,809 B1, issued to Chun-Yuan on Apr. 16, 2002, discloses an electrical connector comprising a rectangular insulating unit 1 defining a plurality of terminal accommodating grooves 10 respectively receiving terminals 3 therein and an integral metal enveloping unit 2 enveloping said insulating unit 1. However, the above-mentioned shielding member or integral metal enveloping unit is made of metal sheet and encloses the insulative base or insulative unit by bending the shielding member or metal enveloping unit into a quadrangular configuration, so a slit is defined between free ends of the metal sheet, thus the shield may loosen from the insulative base or insulative unit when external forces are exerted thereon. Furthermore, some conventional electrical connectors have shielding members with their solder tabs and holding tabs integrated together. The holding tab is subject to displacement when the solder tab is soldered onto an electrical circuit board, thereby making the shielding member loosen from the insulative housing. In addition, the above-mentioned conventional shielding members are all individually produced which is not suitable for mass production.

Hence, an improved electrical connector is required to overcome the disadvantages of the related art.

BRIEF SUMMARY OF THE INVENTION

The object of the present invention is to provide an electrical connector with a shield securely attached and a method of making such an electrical connector, wherein the shield is formed by drawing and stamping and is suitable for mass production.

An electrical connector according to the present invention comprises an insulative base, a shielding member and a plurality of terminals received in the insulative base. The insulative base has a base plate and a pair of side portions formed at lateral sides of the base plate. The base plate has a top wall, a bottom wall, a first side wall and a second side wall. Each side portion defines a receiving cavity therein. The insulative base has a mating board extending upwardly from the top wall of the base plate. A plurality of fixing members and wedges are formed on the first side wall and the second side wall of the base plate. The mating board has a plurality of terminal receiving grooves. The shielding member has a chamber for accommodating the base plate and the mating board. The shielding member also has a pair of side walls and a chamber defined between the side walls. Each side wall has a pair of mating holes and mating recesses. A plurality of solder tabs extend from bottom edges of the side walls. Each terminal includes a mating portion, a fixing portion extending from the mating portion, a bending portion extending perpendicularly to the fixing portion and a soldering portion extending parallel to the fixing portion. In assembly, each mating portion of the terminals is received in a corresponding terminal receiving groove. The shielding member shields the insulative base. The wedges and the fixing members respectively engage with corresponding mating holes and mating recesses. Each lateral end of the shielding member is inserted into the receiving cavity.

A method of making the electrical connector is as follows: providing an insulative base defining a receiving cavity in each lateral side thereof; providing a shielding member formed by drawing; providing a plurality of terminals; assembling the insulative base, the shielding member and the terminals together with opposite lateral end portions of the shielding member received in corresponding receiving cavities of the insulative base.

Other objects, advantages and novel features of the invention will more apparent from the following detailed description of the present embodiment when taken in conjunction with the accompanying drawings.

DETAILED DESCRIPTION OF THE INVENTION

Figure 1:
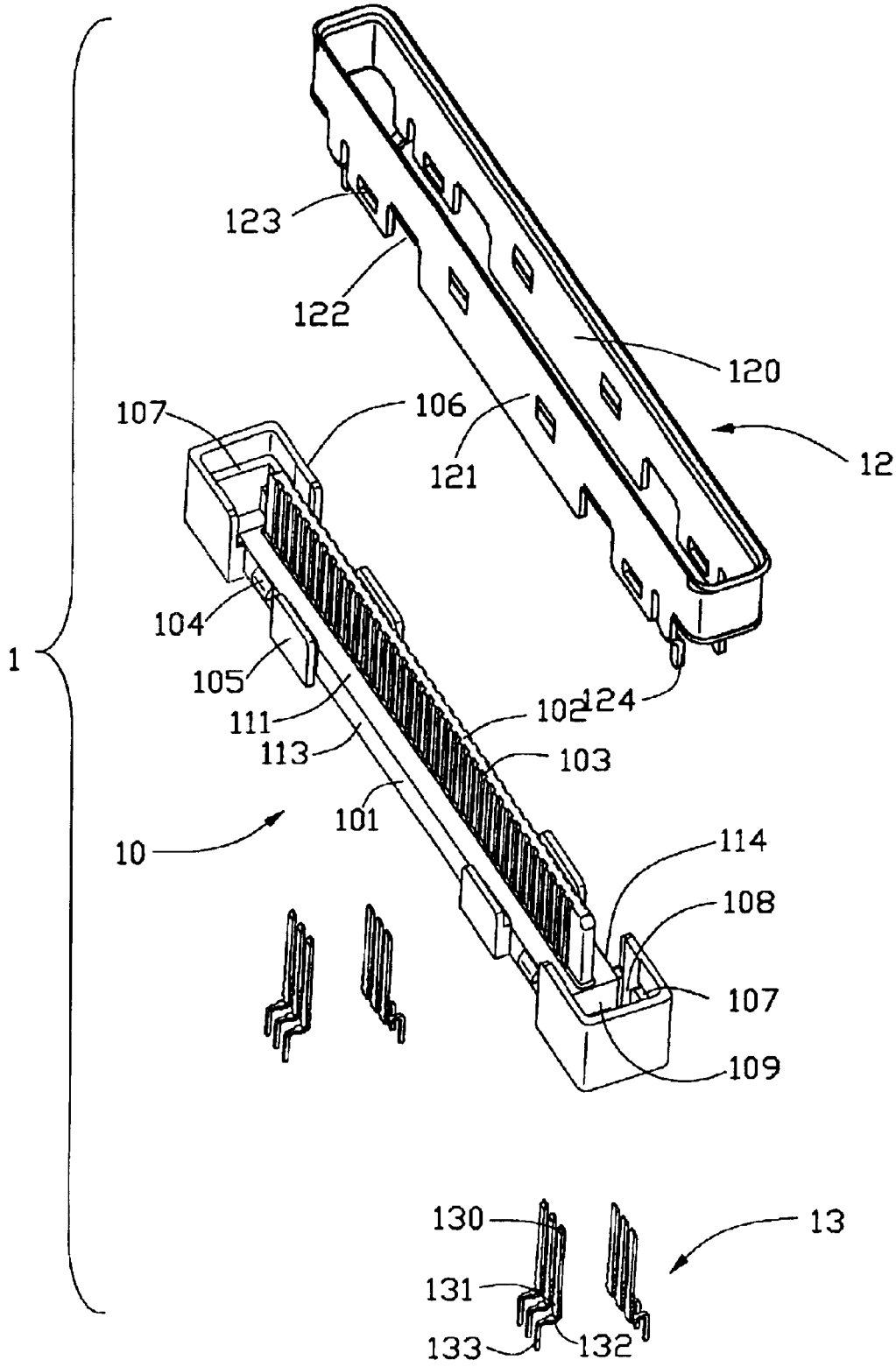
FIG. 1 is an exploded view of an electrical connector in accordance present invention.

Referring to FIG. 1, an electrical connector 1 in accordance with the present invention comprises an insulative base 10, a shielding member 12 and a plurality of terminals 13 received in the insulative base 10.

The insulative base 10 includes a base plate 101. The base plate 101 has a top wall 111, a bottom wall 112, a first side wall 113 and a second side wall 114. The insulative base 10 has a mating board 102 extending upwardly from the top wall 111 of the base plate 101. The insulative base 10 has a pair of side portions 106 symmetrically formed at two lateral sides of the base plate 101. Each of the first and second side walls 113, 114 of the base plate 101 has a pair of fixing members 105 formed thereon. The base plate 101 also has a pair of wedges 104 formed between the fixing members 105 and the side portions 106 on each of the first side wall 113 and the second side wall 114. The mating board 102 has a plurality of terminal receiving grooves 103 defined symmetrically at opposite sides. The side portions 106 each defines a receiving cavity 109 and forms a flange 107 on an inner wall thereof. Each side portion 106 defines a pair of channels 108 adjacent to the flange 107 thereof.

The shielding member 12, drawn in an integral quadrangular configuration, has a pair of side walls 121 and a chamber 120 defined between the side walls 121 for accommodating the base plate 101 and the mating board 102. Each side wall 121 has a pair of mating holes 123 for engaging with corresponding wedges 104 of the base plate 101 and a pair of mating recesses 122 defined adjacent to corresponding mating holes 123 for receiving corresponding fixing members 105 of the first side wall and second side wall 113, 114 of the base plate 101. Each side wall 121 of the shielding member 12 has a pair of solder tabs 124 extending from bottom edges thereof.

Each terminal 13 has a mating portion 130, a fixing portion 131 extending from the mating portion 130, a bending portion 132 bent substantially perpendicularly to the fixing portion 131, and a soldering portion 133 extending from the bending portion 132 and substantially parallel to the mating portion 130.

Figure 2:
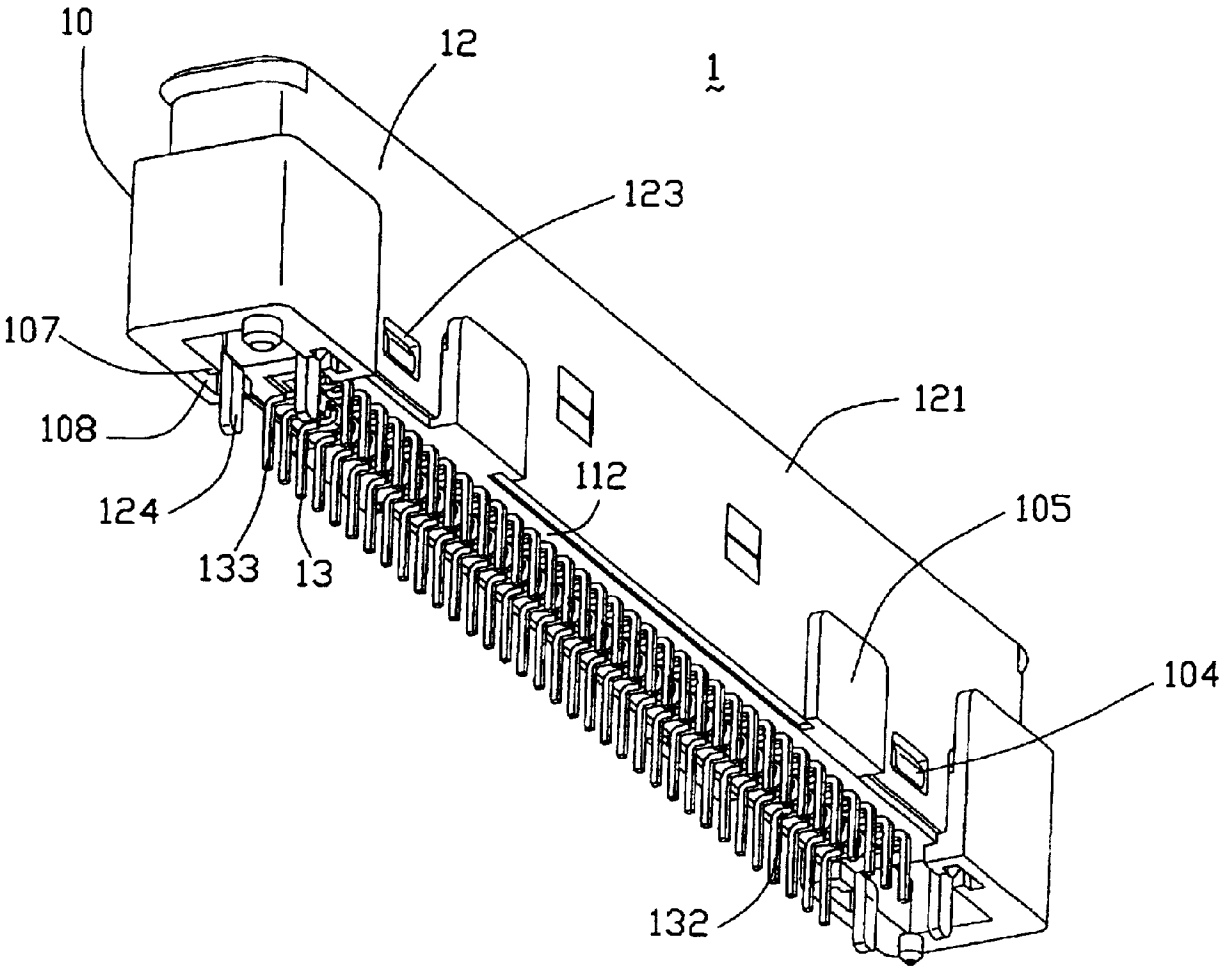
FIG. 2 is an assembled view of the electrical connector shown in FIG.
Figure 3:
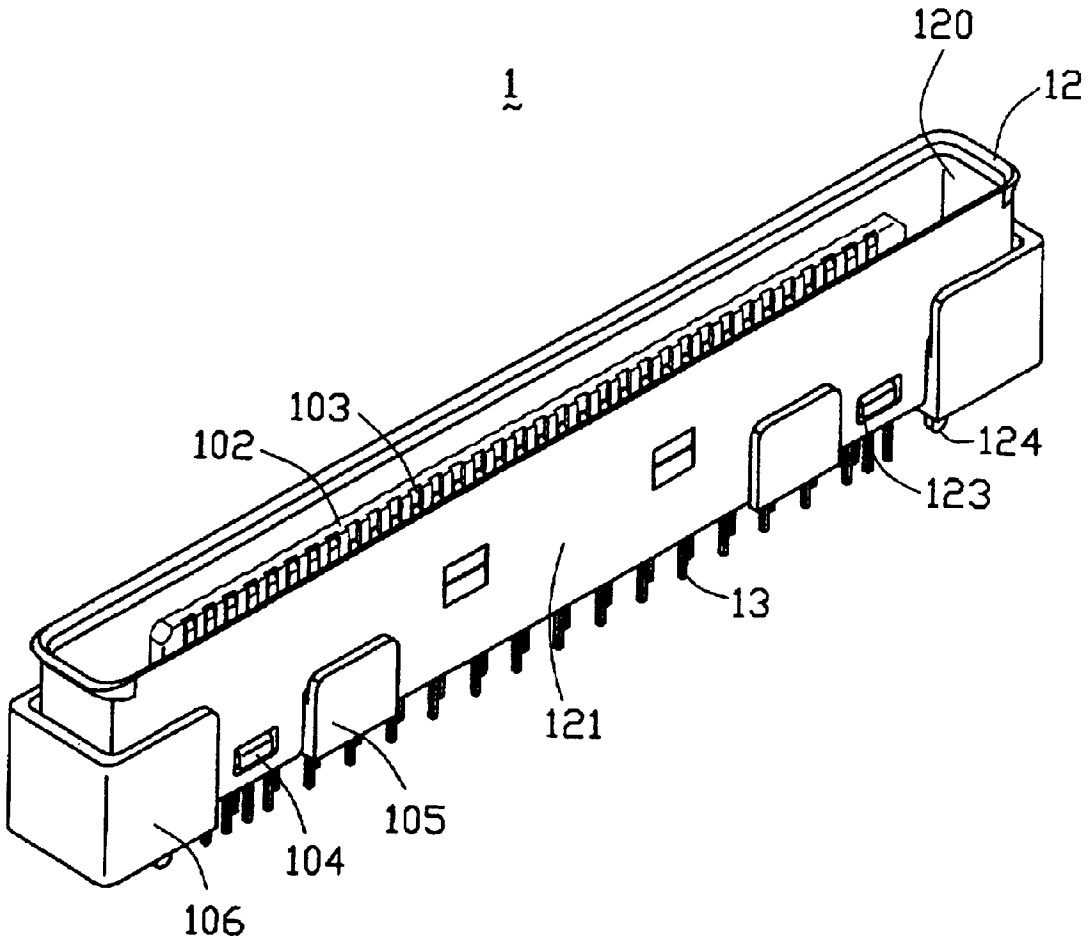
FIG. 3 is an assembled view of the electrical connector shown in FIG. 1, but viewed from a different aspect.

In assembly, as shown in FIGS. 1, 2 and 3, the mating portions 130 of the terminals 13 are respectively received in corresponding terminal receiving grooves 103 of the insulative base 10. The shielding member 12 is assembled to the insulative base 10 with the base plate 101 and the mating board 102 accommodated in the chamber 120 of the shielding member 12. The wedges 104 and the fixing members 105 of the insulative base 10 respectively engage with the mating holes 123 and the mating recesses 122 of the shielding member 12. Each lateral side of the shielding member 12 is inserted into a corresponding receiving cavity 109 with a bottom edge abutting against the flange 107 of the receiving cavity 109. The solder tabs 124 extend through corresponding channels 108 of the insulative base 10 and project downwardly from a bottom surface of the insulative base 10.

A method of making the electrical connector 1 in accordance with the present invention has following steps:

(a) providing the insulative base 10, the insulative base comprises a mating board extending upwardly from a top face thereof for being received in a mating connector and a side portion formed at each lateral side thereof and extending upwardly beyond the top face, each side portion defining a receiving cavity;

(b) providing the shielding member 12, drawn in an integral quadrangular configuration which includes the following steps: positioning a metal plate connecting with a carrier between a top mold and a bottom mold; and drawing an opening at a middle portion of the metal plate, with the carrier connecting with a bottom edge of the metal plate;

(c) providing the plurality of terminals 13;

(d) assembling the plurality of terminals in the insulative base;

(e) severing the carrier from the bottom edge of the metal plate to separate the shielding member; and (f) assembling the shielding member to the insulative base from the top with the bottom edge received in the receiving cavity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative base comprising a base plate, and a pair of side portions formed at lateral sides of the base plate and extending upwardly beyond a top face of the base plate, each side portion defining a receiving cavity therein;

a plurality of terminals received in the insulative base; and a shielding member attached to the insulative base, the shielding member comprising lateral bottom edges substantially received in corresponding receiving cavities.

2. The electrical connector as described in claim 1, wherein said insulative base has a mating board extending upwardly from the base plate.

3. The electrical connector as described in claim 1, wherein said shielding member is an integral enveloping unit.

4. The electrical connector as described in claim 2, wherein the mating board has a pair of side walls, each side wall defining a plurality of terminal receiving grooves.

5. The electrical connector as described in claim 4, wherein each terminal has a mating portion received in a corresponding receiving groove, a fixing portion extending from the mating portion, a bending portion bent substantially perpendicularly to the fixing portion, and a soldering portion extending substantially parallel to the mating portion.

6. The electrical connector as described in claim 1, wherein the base plate has a first wall and a second wall, each wall having a wedge, and the shielding member has a pair of elongated side walls having receiving holes engaging with corresponding wedges of the base plate.

7. The electrical connector as described in claim 6, wherein each of the first and second walls of the base plate has a rectangular fixing member, and each elongated side wall of the shielding member has a mating recess receiving a corresponding fixing member.

8. The electrical connector as described in claim 1, wherein each side portion of the base plate has a flange formed on an inner wall thereof.

9. The electrical connector as described in claim 6, wherein the shielding member has a plurality of solder tabs extending downwardly from bottom edges of the side walls thereof.

10. The electrical connector as described in claim 9, wherein each side portion of the insulative base has a pair of channels for the solder tabs of the shielding member extending therethrough.

11. An electrical connector, comprising:

an insulative base comprising a pair of enlarged side portions formed at opposite lateral sides thereof, each side portion defining a receiving cavity therein and forming a flange on an inner wall thereof;

a plurality of terminals received in the insulative base;

a shield attached to the insulative base, the shield including substantially lateral side portions received in corresponding receiving cavities with a bottom edge of each lateral side abutting against the flange of a corresponding receiving cavity; and interengaging means arranged between the shield and the insulative base so as to securely attach the shield to the insulative base.

12. A method of making an electrical connector comprising the steps of:

providing an insulative base, the insulative base comprising a mating board extending upwardly from a top face thereof for being received in a mating connector and a side portion formed at each lateral side thereof and extending upwardly beyond the top face, each side portion defining a receiving cavity;

providing a shielding member which comprises the following steps: positioning a metal plate connecting with a carrier between a top mold and a bottom mold; and drawing an opening at a middle portion of the metal plate, with the carrier connecting with a bottom edge of the metal plate;

providing a plurality of terminals;

assembling the plurality of terminals in the insulative base;

severing the carrier from the bottom edge of the metal plate to separate the shielding member; and assembling the shielding member to the insulative base from the top with the bottom edge received in the receiving cavity.

13. An electrical connector comprising:

rectangular insulative base having a base plate and a mating board extending upwardly from a top face of the base plate;

a pair of U-shaped side portions formed at two lateral ends of the base plate and extending upwardly beyond the top face of the base plate;

a plurality affixing members formed on elongated sides of the base plate;

a plurality of wedges formed on the elongated sides of the base plate, each wedge being not aligned with any of the fixing members in a vertical direction;

a circumferential shield positioned upon the top face of the base plate, enclosing the mating board, and circumferentially enclosed by said pair of U-shaped side portions and the fixing members; wherein said shield includes mating holes receiving said wedges therein, respectively.

14. The connector as described in claim 13, wherein said shield further includes a plurality of solder tabs extending through a bottom face of the base inside the corresponding U-shaped side portions.

* * * * *